US006622385B1

(12) United States Patent
Steinberg

(10) Patent No.: US 6,622,385 B1
(45) Date of Patent: Sep. 23, 2003

(54) TRIMMER DRIVE MEANS FOR ROTARY ELECTRIC SHAVER

(76) Inventor: Hy Steinberg, 9646 W. McNab Rd., Tamarac, FL (US) 33321

( * ) Notice: Subject to any disclaimer, the term of this patent is extended or adjusted under 35 U.S.C. 154(b) by 0 days.

(21) Appl. No.: 10/372,585

(22) Filed: Feb. 21, 2003

(51) Int. Cl.[7] ..... B26B 19/14
(52) U.S. Cl. ..... 30/34.1
(58) Field of Search ..... 30/34.1, 34.05, 30/43.6, 43.9

(56) References Cited

U.S. PATENT DOCUMENTS

| | | | | | |
|---|---|---|---|---|---|
| 3,392,443 | A | * | 7/1968 | Kawano et al. | 30/34.1 |
| 3,552,007 | A | * | 1/1971 | Yamada | 30/34.1 |
| 3,781,990 | A | * | 1/1974 | Loner | 30/34.1 |
| 4,355,464 | A | * | 10/1982 | Bergsma | 30/34.1 |
| 4,649,642 | A | * | 3/1987 | Nagasaki et al. | 30/34.1 |

* cited by examiner

*Primary Examiner*—Douglas D. Watts

(57) ABSTRACT

A reciprocating linear drive means for a pop-up trimmer on a rotary electric shaver with cutting heads that are mounted on a rotating, circular head frame.

7 Claims, 2 Drawing Sheets

SECTIONS A-A
FIGURE 2
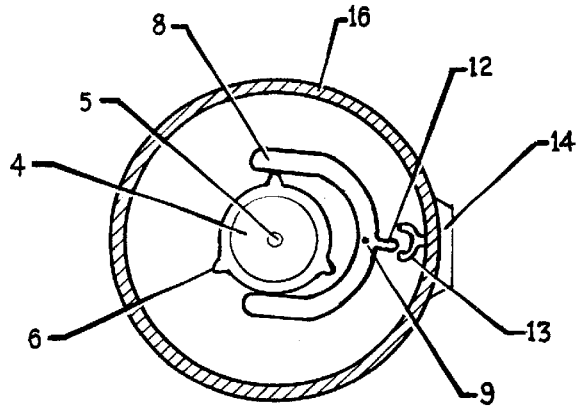
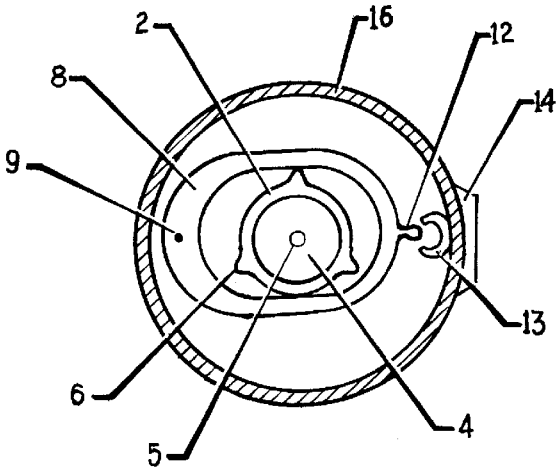
FIGURE 3
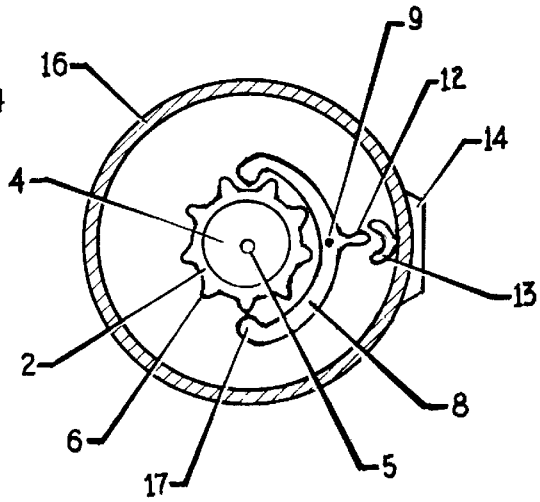
FIGURE 4

TRIMMER DRIVE MEANS FOR ROTARY ELECTRIC SHAVER

BACKGROUND OF THE INVENTION

Field of the Invention

Rotary electric shavers having a plurality of planetary, rotating cutting heads and a hair trimming attachment.

SUMMARY OF THE INVENTION

The present invention arose as a result of the absence in prior art of a means for producing the reciprocating motion required to operate a pop-up trimmer in an electric shaver with rotary cutting heads that are in planetary motion. The conventional drive means for operating a pop-up trimmer cannot be utilized in such shavers because the cutting heads and drive gear assemblies are mounted on a rotating frame within the stationary body of the shaver.

In current practice, the drive means for a pop-up trimmer consists of a hinged cam that surrounds the offset axis of a cutting head drive gear to produce a reciprocating motion that drives the cutting elements of the trimmer. In the present invention, protrusions on the surface of the rotating frame consecutively move a hinged cam to provide the reciprocal motion required for the operation of a pop-up trimmer.

BRIEF DESCRIPTION OF THE DRAWINGS

FIG. 2 is a view of the circular portion of the shaver, as indicated by the section A—A of FIG. 1, which further illustrates the configuration for the drive means shown in FIG. 1.

FIG. 3 is a view of the circular portion of the shaver, as indicated by the section A—A of FIG. 1, illustrating a configuration for the drive means that increases the width of the reciprocal motion produced.

FIG. 4 is a view of the same portion of the shaver, as in section A—A of FIG. 1, illustrating a high-speed configuration for the drive means of this invention.

DETAILED DESCRIPTION OF THE INVENTION

Figure 1:
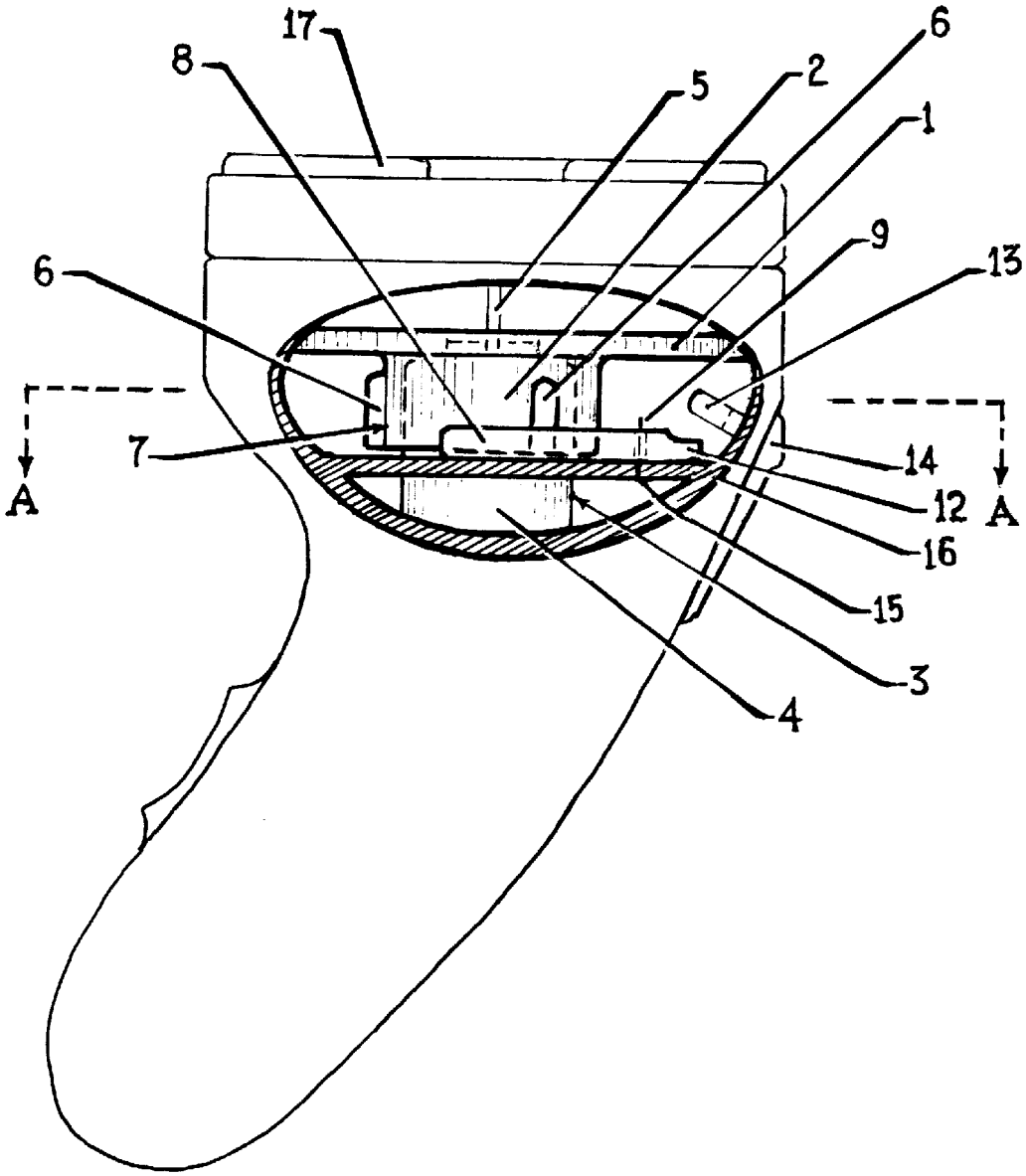
FIG. 1 is an elevation view of a rotary electric shaver with a rotating head frame wherein a side portion of the shaver's outer body is removed to show the elements of this invention.

The present invention is a drive means that permits the transfer of power from a rotating frame within a rotary electric shaver to a pop-up trimmer attachment on the stationary body of the shaver.

FIG. 1 illustrates how this transfer of power is accomplished. A portion (hatched) of the stationary outer body (16) of the shaver is removed to show all of the elements of this invention. The bottom of the rotating frame (1) is extended with an open-ended cylindrical extension (2) that is in sliding contact with the cylindrical outer surface (3) of the electric drive motor (4) located below the rotating frame (1). The extension (2) has at least three protrusions (6) spaced equidistantly on its circular outer surface (7) and it is surrounded by a lateral cam (8). The cam (8) is hinged with a vertical pin (9) at a position close to the trimmer (14) and it has a protruding stem (12) that is shaped to fit within the open jaw (13) of the hinged trimmer (14) when the trimmer is popped up for activation and use. As the extension (2) rotates, each of its protrusions (6) consecutively exert a moving force on the inner surface of the cam (8) to produce the reciprocating force at the stem (12) that is needed to operate the trimmer (14) when it is in its active position.

The engagement element (13) and other elements of the trimmer (14) are of conventional design, as commonly used in rotary electric shavers, and they are not a part of the invention claimed herein.

The operating speed of the drive means depends upon the speed of frame (1) rotation multiplied by the number of protrusions (6) on the extension (2). The maximum operating speed of a trimmer drive configuration with three protrusions (6), as in FIG. 2 and FIG. 3, is approximately 24 reciprocating cycles per second, for an average motor shaft (5) speed of 3,000 rpm.

FIG. 2 is a sectional view as seen from direction A—A in FIG. 1. The three protrusions (6) are spaced equidistantly around the circular outer surface (7) of the cylindrical extension (2) to consecutively exert a moving force on the cam (8) that partially surrounds extension (2) and is hinged with a vertical pin (9) located near the trimmer (14). The resulting reciprocal motion is transmitted from the stem (12) to the open jaw of the trimmer engagement element (13) when the hinged trimmer (14) is popped up for activation. The hinge pin (9)) can either be a molded part of the cam (8) that rotates within a hole in a stationary part of the shaver body (15 in FIG. 1) or it can be a fixed pin within the shaver body that penetrates a hole in the cam to provide free movement of the cam. The end of the stem (12) is appropriately shaped to fit within the open jaws of the trimmer's engagement element (13). The configuration shown in FIG. 2 is preferable because of its simplicity and minimal space requirement. However, the width of reciprocal movement of the stem (12) is limited by its proximity to the hinge pin (9).

FIG. 3 illustrates a cam (8) configuration wherein the cam completely surrounds the cylindrical extension (2) and three protrusions (6). The hinge pin (9) is located in the cam (8) at its furthest point from the engagement element (13). This remote pin location produces a wider reciprocal movement of the stem (12) and can increase the effectiveness of the pop-up trimmer (14).

FIG. 4 illustrates a cam configuration that can produce a higher operating speed for the trimmer, if such speed is preferable. The cam (8) surrounds only a portion of the cylindrical extension (2) but it has a wider interior surface with inwardly curved prongs (17) that permit a larger number of protrusions (6) to consecutively exert a reciprocating force on cam (8). The protrusions (6) are spaced around the extension (2) so that not more than one protrusion is in a position to move the interior surface of the cam (8) during the rotation of the extension (2).

The embodiments of the invention described and illustrated herein are not meant to exclude other configurations or the substitution, addition, or modification of any of the elements or materials used, in order to practice the teachings that are within the scope of the claims of this invention.

I claim:

1. An electric shave, comprising reciprocating drive means for the operation of a trimmer attached to the body of said electric shaver wherein said shaver contains a plurality of cutting heads mounted on a circular frame that rotates about the drive shaft of an electric motor within said shaver, said drive means consisting of;

an open-ended cylindrical extension at the bottom of said rotating frame that surrounds and rides rotates around the outer surface of said motor, said extension having protrusions equidistantly spaced around its outer surface, and;

a laterally moveable cam surrounding said extension, wherein the rotation of said extension and alternating consecutive movement and pressure of said protrusions against the inner surface of said cam converts the circular motion of said frame into a reciprocating motion of said cam produces a reciprocal cam movement.

2. A drive means according to claim 1, wherein said extension and said protrusions are an integral part of said extension rotating frame.

3. A drive means according to claim 1, wherein said protrusions are positioned equidistantly around the surface of said rotating extension to consecutively and alternatively exert a moving force against of said cam said cam surface during the rotation of said extension.

4. A drive means according to claim 1, wherein said cam moves laterally back and forth about the axis of a perpendicular hinge pin, said pin being an integral part of said cam and shaped to move freely within a hole in a part of the body of said shaver, or said pin being fixed within a part of said shaver and freely contained at its other end within a hole in said cam.

5. A drive means according to claim 4, wherein said pin is located in a part of said cam that is between said extension and said trimmer.

6. A drive means according to claim 4, wherein said pin is located in a part of said cam that is furthest from said trimmer.

7. A drive means according to claim 4, wherein said cam has a stem on its outer edge for engagement or disengagement with the open jaw of the drive element for said trimmer.

* * * * *

UNITED STATES PATENT AND TRADEMARK OFFICE

CERTIFICATE OF CORRECTION

PATENT NO. : 6,622,385 B1
DATED : September 23, 2003
INVENTOR(S) : Hy Steinberg

It is certified that error appears in the above-identified patent and that said Letters Patent is hereby corrected as shown below:

Column 2,
Line 57, "shave" should be -- shaver, --
Line 64, the word "rides" should be removed Column 3,
Lines 5 and 6, the words "reciprocating motion of said cam produces a" should be removed
Line 10, the word "extension" should be removed
Line 14, the words "of said cam" should be removed Signed and Sealed this Eleventh Day of November, 2003

JAMES E. ROGAN
*Director of the United States Patent and Trademark Office*